US006736634B2

(12) United States Patent
Manohar et al.

(10) Patent No.: US 6,736,634 B2
(45) Date of Patent: May 18, 2004

(54) $NO_X$ REDUCTION WITH A COMBINATION OF RADIATION BAFFLE AND CATALYTIC DEVICE

(75) Inventors: Shailesh Sharad Manohar, Manlius, NY (US); Young Kyu Park, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/054,491

(22) Filed: Jan. 24, 2002

(65) Prior Publication Data

US 2003/0170581 A1 Sep. 11, 2003

(51) Int. Cl.[7] ..... F23D 14/12
(52) U.S. Cl. ..... 431/328; 126/116 A; 431/268
(58) Field of Search ..... 431/268, 7, 326, 431/328; 126/110 R, 116 R, 116 A, 91 A; F23D 14/12; F23Q 11/04; F24H 3/08

(56) References Cited

U.S. PATENT DOCUMENTS 4,318,392 A * 3/1982 Schreiber et al. ..... 126/110 R
4,776,320 A * 10/1988 Ripka et al. ..... 126/99 A
5,222,476 A * 6/1993 Chmielewski ..... 126/110 C
5,326,253 A * 7/1994 Dalla Betta et al. ..... 431/7
5,331,944 A * 7/1994 Kujawa et al. ..... 126/110 R
5,405,260 A * 4/1995 Della Betta et al. ..... 431/7
5,425,632 A * 6/1995 Tsurumi et al. ..... 431/7
5,511,972 A * 4/1996 Dalla Betta et al. ..... 431/170
5,518,697 A * 5/1996 Dalla Betta et al. ..... 422/173
5,562,440 A * 10/1996 Rodgers ..... 431/328
5,746,194 A * 5/1998 Legutko ..... 126/91 A
5,848,887 A * 12/1998 Zabielski et al. ..... 431/353
5,975,890 A * 11/1999 Kawasaki et al. ..... 431/328
6,067,979 A * 5/2000 Jaasma et al. ..... 126/77
6,145,501 A * 11/2000 Manohar et al. ..... 126/110 R
6,267,792 B1 * 7/2001 Nagamiya et al. ..... 48/197 R
6,270,336 B1 * 8/2001 Terashima et al. ..... 431/6
6,302,683 B1 * 10/2001 Vestin et al. ..... 431/7

* cited by examiner

*Primary Examiner*—Henry Bennett
*Assistant Examiner*—James G. Barrow

(57) ABSTRACT

In a fuel gas burner, a reduction of $NO_x$ emissions is brought about by the combined use of both a catalyst and a radiation baffle. The catalyst and baffle are located in serial flow relationship such that each contributes to the $NO_x$ reduction function without the creation of undesirable conditions. The catalyst is located upstream of the flame and the amount of primary air supplied to the burner is controlled so as to bring about a reduction of $NO_x$ emissions while at the same time not allowing the temperature of the catalyst to exceed a threshold limit, thereby ensuring an acceptably long life and durability of the catalyst. The radiation baffle is located in the flame to radiate heat away therefrom and lower the temperature thereof to reduce $NO_x$ emissions, with the mass of the baffle being limited such that no significant levels of CO are generated.

6 Claims, 1 Drawing Sheet

$NO_x$ REDUCTION WITH A COMBINATION OF RADIATION BAFFLE AND CATALYTIC DEVICE

TECHNICAL FIELD

The present invention relates generally to gas fired combustion apparatus such as residential and light commercial furnaces and the like. More particularly, the present invention relates to a combustion system for use in such a gas fired apparatus characterized by a reduced level of emission of oxides of nitrogen ($NO_x$).

BACKGROUND OF THE INVENTION

During the combustion of fossil fuels, including gaseous fuels such as natural gas, liquefied natural gas and propane, for example, in air, $NO_x$ is formed and emitted to the atmosphere in the combustion products. With respect to gaseous fuels that contain little or no fuel-bound nitrogen per se, $NO_x$ is largely formed as a consequence of oxygen and nitrogen in the air reacting at the high temperatures resulting from the combustion of the fuel.

Governmental agencies have passed legislation regulating the amount of oxides of nitrogen that may be admitted to the atmosphere during the operation of various combustion devices. For example, in certain areas of the United States, regulations limit the permissible emission of $NO_x$ from residential furnaces to 40 ng/J (nanograms/Joule) of useful heat generated by these combustion devices. It is expected that future regulations will restrict $NO_x$ emissions from residential furnaces and boilers to even lower levels.

Gas fired apparatus, such as residential and light commercial heating furnaces, often use a particular type of gas burner commonly referred to as an in-shot burner. An in-shot burner comprises a burner nozzle having an inlet at one end for receiving separate fuel and primary air streams and an outlet at the other end through which mixed fuel and primary air discharges from the burner nozzle in a generally downstream direction. The burner nozzle may simply comprise an axially elongated, straight tube, or it may comprise a generally tubular member, which may be arcuate or straight, having an inlet section, an outlet section and a transition section, commonly referred to as a venturi section, disposed therebetween. Fuel gas under pressure passes through a central port disposed at or somewhat upstream of the inlet of the burner nozzle. The diameter of the inlet to the burner nozzle is larger than the diameter of the fuel inlet so as to form an annular area through which atmospheric air is drawn into the burner nozzle about the incoming fuel gas. This primary air mixes with the fuel gas as it passes through the tubular section of the burner nozzle to form a primary air/gas mix. This primary air/gas mix discharges from the burner nozzle through the outlet of the burner nozzle and ignites as it exits the nozzle outlet section forming a flame projecting downstream from a flame front located adjacent or somewhat downstream of the outlet of the burner nozzle. Secondary air flows around the outside of the burner nozzle and is entrained in the burning mixture downstream of the nozzle in order to provide additional air to support combustion.

In conventional practice, a flame retention device is often inserted within the outlet section of the burner in an attempt to achieve improved flame stability and reduction of noise. One known insert comprises a cylindrical body defining a central opening and having a toothed perimeter formed by a plurality of circumferentially spaced, axially elongated splines extending radially outwardly in a sunburst pattern about the circumference of the cylindrical body.

U.S. Pat. No. 6,145,501, assigned to the assignee of the present invention, shows an in-shot burner having a catalyst disposed in its outlet end thereof for the purpose of catalyzing the fuel in the primary air/fuel mixture to intermediate combustion species to thereby reduce emissions such as nitrogen oxides. In the example described, the total air provided is 145% of that required for stiochiometric combustion, with primary air being provided at about 50%, thereby reducing $NO_x$ to 28.59 ppm, or 22 ng/J. While this may meet the needs for $NO_x$ reduction, it will require the catalyst to operate at relatively high temperatures so as to thereby result in a relatively short life (i.e. <1000 hours of operation) of the catalyst.

U.S. Pat. No. 4,776,320, Ripka et al., discloses a gas-fired furnace utilizing an in-shot burner wherein a thermal energy radiator structure, such as a perforated stainless steel structure, is disposed in the flame downstream of the burner outlet. The radiator structure tempers the flame by absorbing heat therefrom and radiating the absorbed heat to the surrounding heat transfer surface, whereby peak flame temperatures are limited and $NO_x$ formation is reduced.

A problem associated with the reduction of nitrogen oxide formation by lowering the flame temperature is that as the flame is quenched, combustion may not be totally completed. As a consequence of flame quenching, carbon monoxide formation will increase as nitrogen oxide formation decreases. Thus, the radiator structure of the '320 patent would be capable of reducing $NO_x$ emissions from 45 ng/J to 35 ng/J at acceptable CO levels. Attempts to lower $NO_x$ further, however, would result in the generation of carbon monoxide at a level above that permitted by regulations.

To avoid the consequence of increased carbon monoxide formation associated with reduction of $NO_x$ emissions by reducing peak flame temperatures, attempts have been made to reduce nitrogen oxides formation by using a catalyst to promote chemical reactions which result in a reduction of $NO_x$ formation in the flame. U.S. Pat. No. 5,746,194, Legutko, discloses a combustion system having an in-shot burner wherein a flow dividing member supports a partial oxidation catalyst disposed in the fuel rich inner core of the flame downstream of the burner outlet. The catalyst serves to catalyze unburnt methane in the fuel rich inner core of the flame to hydrogen and carbon monoxide. When this hydrogen and carbon monoxide subsequently combust in the air rich outer zone of the flame, the peak combustion temperatures are lower than in conventional combustion and $NO_x$ formation is reduced. The catalytic insert is heated above the reaction "light-off" temperature of the catalyst directly by the flame itself. The catalytic insert also radiates heat away from the flame to further reduce peak temperature within the flame. While such an arrangement results in reduced $NO_x$ levels, while at the same time limiting the generation of CO, because the catalyst is disposed in the flame, it is difficult to maintain the temperature of the catalyst at a level low enough to ensure long-term reliability thereof.

U.S. Pat. No. 5,848,887, Zabielski et al., shows another approach for using both a catalyst and a radiation body for decreasing $NO_x$ while limiting the generation of CO. The radiator body is disposed in the flame downstream of an in-shot burner to quench the flame to reduce $NO_x$ formation, while the catalyst is disposed further downstream of the flame in a lower temperature region for oxidizing carbon monoxide in the flue gas to carbon dioxide. In this way, the catalyst is provided to clean up the CO which is generated by the radiating body, and the problem of exposing the catalyst to high temperatures and a short life, is solved by locating the catalyst at a relatively remote location downstream where the temperatures are not excessive. However, in the event that the catalyst does become ineffective for any reason, the resulting system will be similar to that described in the '501 patent discussed hereinabove wherein the heat radiating device will reduce $NO_x$ but may cause excessive levels of CO to be present.

It is therefore an object of the present invention to provide an improved fuel air combustion apparatus and method of operation.

This object and other features and advantages become readily apparent upon reference to the following descriptions when taken in conjunction with the appended drawings.

SUMMARY OF THE INVENTION

Briefly, in accordance with one aspect of the invention, a catalyst is provided at a position substantially upstream of the flame, and the amount of primary air which is provided to the burner is limited so as to thereby reduce $NO_x$ emissions from the burner but maintain a relatively low temperature at the catalyst and thereby prolong its life. In one embodiment, the catalyst is composed of a ceramic honeycomb material with a noble metal (i.e. rhodium, platinum or palladium), and the amount of primary air is limited to 45 percent of that required for stoichiometric combustion such that the temperature of the catalyst does not exceed 2000 deg. F.

In accordance with another aspect of the invention, a baffle is provided in the flame so as to radiate heat therefrom to further reduce $NO_x$ emissions. The mass of the radiation baffle is limited so as not to reduce the flame temperature to a level which will cause any significant generation of CO.

In accordance with yet another aspect of the invention, the amount of primary air being provided to the burner is controlled to at least 25 percent of that required for stoichiometric combustion, such that, in the event of a catalyst failure, complete combustion of the fuel/air mixture will occur.

In the drawings as hereinafter described, a preferred embodiment is depicted; however, various other modifications and alternate constructions can be made thereto without departing from the true spirit and scope of the invention.

BRIEF DESCRIPTION OF THE DRAWINGS

Referring now to FIG. 1, the invention is shown generally at 10 as applied to an in-shot burner tube or nozzle 11 having an inlet 12 and an outlet 13, with an axially elongated transition section 14 extending therebetween. As shown, the transition section 14 is commonly a venturi. A fuel gas port 16, spaced upstream of and coaxial with the inlet 12 of the nozzle 11, is provided for communication to a fuel gas supply line, not shown. The inlet 12 is preferably flared outwardly in the upstream direction as shown, and has a larger diameter inlet opening than the fuel gas inlet opening defined by the fuel gas port 16 thereby defining an annular region 17 therebetween. In operation, as indicated by the arrows, the primary combustion air is aspirated or pumped through the annular region 17 into the nozzle 11 as the pressurized fuel gas from the supply line passes through the fuel gas port 16 into the burner nozzle 11. As also indicated by the arrows, secondary combustion air passes around the outside of the nozzle 11 and gradually mixes into the flame extending axially downstream from the outlet 13 of the burner into the heat exchanger 18.

DESCRIPTION OF THE PREFERRED EMBODIMENT

Figure 1:
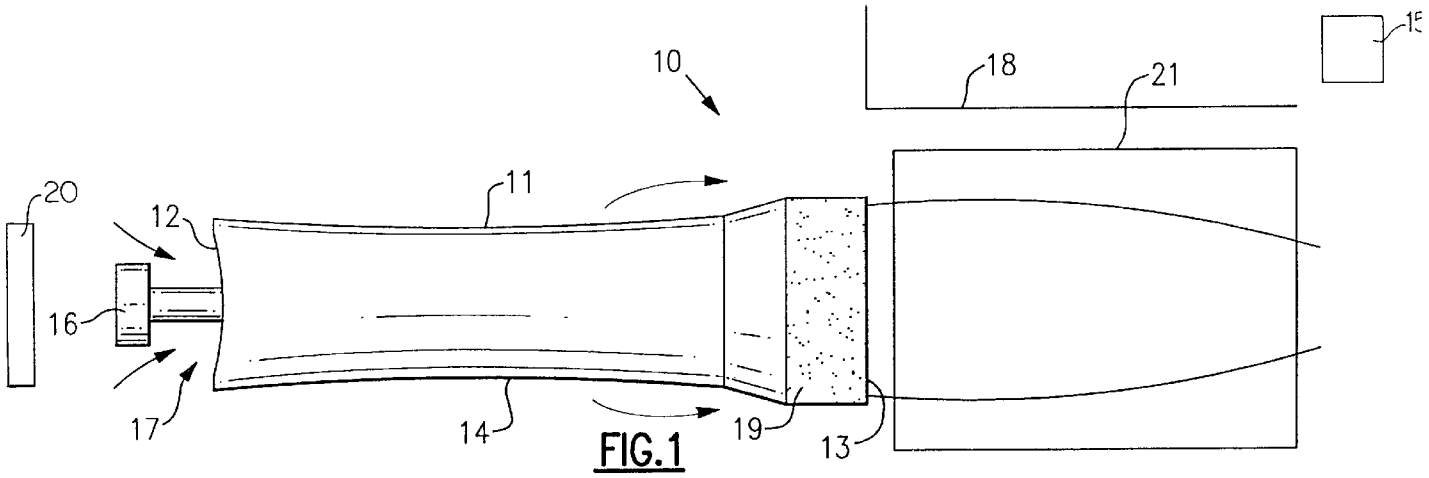
FIG. 1 is a schematic illustration of a combustion system in accordance with the present invention.

Referring now to FIG. 1, the invention is shown generally at 10 as applied to an in-shot burner tube or nozzle 11 having an inlet 12 and an outlet 13, with an axially elongated transition section 14 extending therebetween. As shown, the transition section 14 is commonly a venturi. A fuel gas port 16, spaced upstream of and coaxial with the inlet 12 of the nozzle 11, is provided for communication to a fuel gas supply line, not shown. The inlet 12 is preferably flared outwardly in the upstream direction as shown, and has a larger diameter inlet opening than the fuel gas inlet opening defined by the fuel gas port 16 thereby defining an annular region 17 therebetween. In operation, as indicated by the arrows, primary combustion air is aspirated or pumped through the annular region 17 into the nozzle 11 as the pressurized fuel gas from the supply line passes through the fuel gas port 16 into the burner nozzle 11. As also indicated by the arrows, secondary combustion air passes around the outside of the burner tube 11 and gradually mixes into the flame extending axially downstream from the outlet 13 of the burner into the heat exchanger 18.

Located in or near the outlet 13 is a catalytic insert 19 which is composed of a partial oxidation catalyst operative to catalyze at least a portion of the methane in the fuel gas and primary air mixture to intermediate combustion species, including hydrogen and carbon monoxide, prior to the fuel and primary air mixture exiting the burner outlet 13. The catalytic insert 19 and the manner in which it is employed is carefully selected and controlled so as to provide a limited degree of $NO_x$ reduction while not allowing the temperature of the catalyst to exceed a predetermined temperature which would tend to shorten its useful life. In the first place, its location in a position upstream of the flame is important in being able to control its operating temperature. Secondly, its composition and form, as well as the amount of primary air that is employed in the combustion process is controlled in a manner to be more fully described hereinafter.

Located downstream of the outlet 13, is a radiation baffle 21 which, in one form, comprises a V-shaped device that is disposed within the flame as shown. Its function is to enhance the radiation of heat from the flame and toward the heat exchanger 18 so as to thereby reduce the temperature of the flame and further reduce the $NO_x$ emissions. Again, the particular structure and manner of use is selected to bring about a limited degree of $NO_x$ reduction while not permitting the generation of any significant amounts of CO gas which might otherwise occur if the $NO_x$ reduction process were allowed to proceed to a greater degree. These features will be discussed in greater detail hereinafter.

Figure 2:
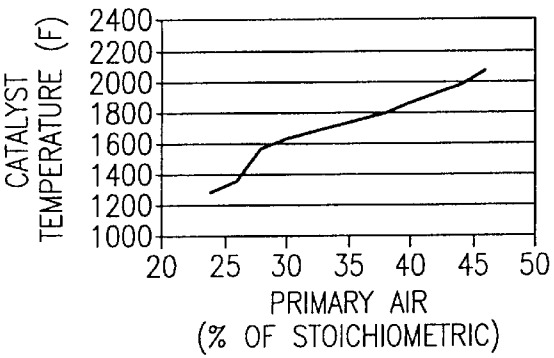
FIG. 2 is a graphical illustration of the relationship between the amount of primary air provided to a burner and the temperature of a catalyst member employed in the burner and composed of a particular material.

Before discussing the details of the catalytic insert 19, it would be well to consider the performance characteristics of a typical catalyst, and in particular its operating temperature as a function of the percentage of primary air with which it is operating. FIG. 2 shows the relationship between these two parameters for a catalyst composed of a rhodium (Rh) material. As will be seen, the temperature of the catalyst is generally proportional to the amount of primary air that is applied to the burner in the combustion process. For example, for a typical burner operation, the percentage of primary air as compared with the stoichiometric air applied is around 50 percent, which results in a catalyst temperature of around 2200 deg. F. The applicants have recognized that a catalyst operating at this temperature will have a life of less than 1000 hours, and the costs and inconvenience of replacement do not warrant the higher levels of $NO_x$ reduction that are obtained at this temperature. It is therefore preferable to operate at lower temperatures so as to obtain lower $NO_x$ reduction levels and longer operating lives greater than 1000 hours for the catalyst. The $NO_x$ reduction function is then augmented by the use of the radiation baffle 21 mentioned above and more fully described hereinafter.

As mentioned hereinabove, the operating temperature for the catalyst should preferably not exceed 1600–1800 deg. F. which, for fully coated catalytic (Rh) monolith the limits, are shown in FIG. 2, corresponds to a 30–40% primary air supply. Thus, the upper limit for the amount of primary air to be provided to the burner is 45%. It should be noted that the insert design can alter these limits. In addition to that requirement, there are also considerations that must be given to the affects that may occur if the amount of primary air is reduced to a level that is too low. In such event, there are two conditions that may prevail. First, when operating at very low levels of primary air, the formation of soot begins to occur, an unacceptable condition for reasons of cleanliness, health and efficiency. Soot can eventually clog up the furnace resulting in expensive repair. Secondly, considering the possibility that the catalyst may eventually become ineffective, the baffle, operating by itself, must be able to function in such a manner as to not generate unacceptable levels of CO. If the primary air supply is reduced beyond a certain level, this could occur. Therefore, for these reasons, a lower limit for a catalyst composed of a rhodium material has been established at 25%, which corresponds to a catalyst temperature of about 1300 F.

Figure 3:
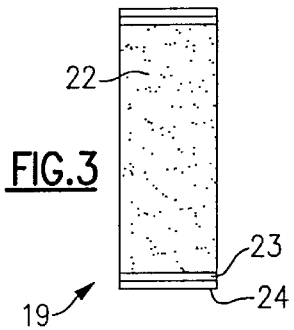
FIG. 3 is a sectional view of catalytic insert portion of the subject invention.

Considering now the particular form of the catalytic insert 19, reference is made to FIG. 3 wherein the insert 19 is shown to comprise a substrate 22, a wash coat 23 and a coating of a catalyst 24. The substrate 22 is preferably a porous structure with a very low pressure drop and composed of a material which can hold up against the operating temperatures. For example, a ceramic material such as cordierite has been found to be suitable for this purpose. Other possible materials include metal foil, etc. The purpose of the wash coat 23 is to provide a lasting bond between the substrate 22 and the catalyst coating 24.

The catalyst coating 24 may be of any suitable material which exhibits catalytic properties, such as Ni, a noble metal (e.g. Pt, Rh, or Pd) or one of the rare earth elements. Depending on the particular material chosen, a suitable temperature limit (such as 1800 degrees for noble metals) must be established to ensure a relatively long life and an acceptable reliability thereof. In turn, to ensure that this temperature is not exceeded, a corresponding maximum threshold level of percentage of primary air must be established and maintained.

Having expressed the requirement for controlling the level of primary air that is supplied to the burner, let us now consider how this parameter may be controlled. In the description of FIG. 1 above, it was mentioned that primary air is aspirated or pumped through the annular region 17. This may be accomplished by an inducer 15 which is operatively connected to the downstream end of the heat exchanger 18 so as to draw air through the heat exchanger 18, and in turn, draw primary combustion air in through the annular region 17 as well as secondary combustion air in near the outlet 13 of the burner. Depending on the pressure drop across the catalytic insert 19, this may or may not be sufficient. It therefore may be necessary to augment this pumping function by proving a pump 20 upstream of the inlet 12 such that sufficient primary air is provided at the annular region 17. In either case, the size of the annular region 17 is a controlling parameter which will partially determine the amount of primary air that enters the inlet 12. In addition, the speed of the inducer and the speed of the upstream air pump (if used) will also affect the amount of primary air that enters the annular region 17. It is therefore these three parameters that must be determined and controlled in order to obtain the desired levels of primary air flow in order to bring about the desired performance as discussed hereinabove.

Figure 4:
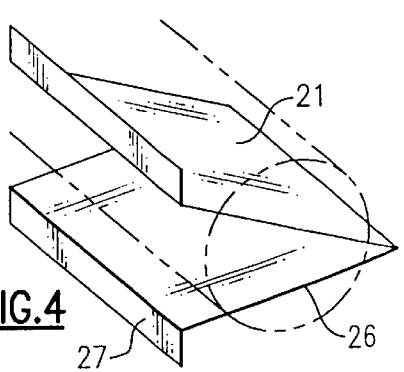
FIG. 4 is a perspective view of a baffle portion of the subject invention.

As discussed hereinabove, the $NO_x$ reducing affect of the catalytic insert 19 is augmented by that of the radiation baffle 21. The baffle, as shown in FIGS. 1 and 4 is located within the area in which the flame occurs. The function, of course, is to radiate heat away from the flame so as to thereby reduce the temperature and $NO_x$ emissions thereof. The baffle can take any form, with one possible form being a V-shaped element 26 with mounting ears 27, as shown. Since the radiating baffle 21 is one of two $NO_x$ reducing devices that are jointly employed, it is not necessary to obtain the maximum degree of $NO_x$ reduction that could be obtained. Further, because we are not only reducing $NO_x$ reductions but are also endeavoring to ensure that the level of the generation of CO gas is maintained at a minimum, the degree of effectiveness of the radiation baffle 21 is necessarily limited and controlled. This is accomplished by determining the proper mass of the radiation baffle 21, in view of other operating parameters such as fuel input rate, excess air, etc. That is, the mass of the radiation baffle 21 should be chosen such that the maximum degree of $NO_x$ reduction can be obtained without the incidence of CO generation.

What is claimed is:

1. A combustion system for use in a fuel-fired apparatus comprising:

a fuel-fired burner having an inlet and an outlet, said burner operative for receiving fuel and primary air in said inlet and generating a primary air and fuel mixture within said outlet to produce a flame extending substantially downstream from said outlet;

a catalyst disposed in said burner for oxidizing at least a portion of the fuel in the primary air and fuel mixture, said catalyst being disposed substantially upstream of the flame;

primary air supply means for controlling the amount of primary air but not the amount of fuel supplied to said inlet at a level which will limit a temperature of said catalyst to a predetermined level commensurate with a long life of said catalyst wherein the amount of primary air supplied to said inlet is substantially below that required for stoichiometric combustion and a radiation baffle disposed in the area of the flame for radiating heat therefrom and reducing the temperature of the flame.

2. A combustion system as set forth in claim 1 wherein said catalyst is composed primarily of a noble metal material and wherein said primary air supply means limits the amount of primary air such that the temperature of the catalyst does not exceed 1800 deg. F.

3. The combustion system as set forth in claim 2 wherein said primary air supply means provides primary air at a rate not exceeding 45 percent of that required for stoichiometric combustion.

4. The combustion system as set forth in claim 2 wherein said primary air supply means provides primary air at a rate of at least 25 percent of that required for stoichiometric combustion.

5. A combustion system as set forth in claim 1 wherein said radiation baffle is limited in its mass so as not to bring about a sufficient reduction of the flame temperature to cause the generation of any significant level of CO in the flame.

6. A combustion system as set forth in claim 1 wherein said catalyst is disposed in said burner outlet.

* * * * *